US009780503B2

(12) United States Patent
Huang et al.

(10) Patent No.: US 9,780,503 B2
(45) Date of Patent: Oct. 3, 2017

(54) CABLE CONNECTOR ASSEMBLY HAVING LIGHT MEMBER

(71) Applicant: FOXCONN INTERCONNECT TECHNOLOGY LIMITED, Grand Cayman (KY)

(72) Inventors: Shuai-Hui Huang, Kunshan (CN); Ru-Yang Guo, Kunshan (CN); Qing-Man Zhu, Kunshan (CN); Jerry Wu, Irvine, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/278,325

(22) Filed: Sep. 28, 2016

(65) Prior Publication Data

US 2017/0093096 A1 Mar. 30, 2017

(30) Foreign Application Priority Data

Sep. 29, 2015 (CN) ..... 2015 2 0760606 U

(51) Int. Cl.

| | |
|---|---|
| ***H01R 3/00*** | (2006.01) |
| ***H01R 13/717*** | (2006.01) |
| ***H01R 13/62*** | (2006.01) |
| ***H01R 24/28*** | (2011.01) |
| ***H01R 13/52*** | (2006.01) |

(Continued)

(52) U.S. Cl.

CPC ..... *H01R 13/7175* (2013.01); *H01R 13/5213* (2013.01); *H01R 13/6205* (2013.01); *H01R 24/28* (2013.01); *H01R 13/504* (2013.01); *H01R 2107/00* (2013.01)

(58) Field of Classification Search

None

See application file for complete search history.

(56) References Cited

U.S. PATENT DOCUMENTS

| | | | | |
|---|---|---|---|---|
| 7,744,231 | B2 | 6/2010 | Hutchinson et al. | |
| 7,753,689 | B1 * | 7/2010 | Wu | H01R 13/648 439/490 |

(Continued)

FOREIGN PATENT DOCUMENTS

| | | |
|---|---|---|
| CN | 103124031 | 8/2015 |
| CN | 102761035 | 10/2015 |

*Primary Examiner* — Tho D Ta

(74) *Attorney, Agent, or Firm* — Wei Te Chung; Ming Chieh Chang

(57) ABSTRACT

A cable connector assembly (100) includes a cable (300) and a connector (200) connected with the cable. The connector includes an insulative housing (1) defining a receiving room (10), a printed circuit board (2) received in the insulative housing, a mating member (3) mounted on the insulative housing and electrically connected with the printed circuit board, a light member (4) mounted on the printed circuit board, a light guide member (5) for guiding the light emitting from the light member to an outer side of the insulative housing, and an outer cover (9) sealing an end of the insulative housing. The light guide member includes a light emitting portion (51) and a light transmission portion (54). The light emitting portion has a column shape having two opposite ends, the light emitted to an outer side of the insulative housing through the two ends of the light emitting portion.

15 Claims, 6 Drawing Sheets

(51) Int. Cl.
*H01R 107/00* (2006.01)
*H01R 13/504* (2006.01)

(56) References Cited

U.S. PATENT DOCUMENTS

| | | | | |
|---|---|---|---|---|
| 7,914,320 | B2 * | 3/2011 | Ko | H01R 13/502 439/490 |
| 8,535,088 | B2 | 9/2013 | Gao et al. | |
| 2010/0065326 | A1 | 3/2010 | Ko | |
| 2013/0034990 | A1 * | 2/2013 | Warren | H01R 13/7175 439/490 |
| 2013/0308304 | A1 | 11/2013 | Tuchrelo et al. | |
| 2015/0214677 | A1 | 7/2015 | Huang et al. | |
| 2016/0240984 | A1 | 8/2016 | Huang et al. | |

* cited by examiner

CABLE CONNECTOR ASSEMBLY HAVING LIGHT MEMBER

BACKGROUND OF THE INVENTION

1. Field of the Invention

The present invention relates to a cable connector assembly, and more particularly to a light structure of the cable connector assembly.

2. Description of Related Arts

U.S. Patent Application Publication No. 2010/0065326, published on Mar. 18, 2010 to Ko, discloses a cable connector assembly comprising a mating member, a printed circuit board (PCB) carrying light-emitting diode (LED), a light guide member, a cable electrically connected with the PCB, and an insulative housing enclosing the PCB and respective portions of the mating member and the cable.

U.S. Pat. No. 8,535,088, issued on Sep. 17, 2013, discloses a reversible cable plug (connector) including two internal PCBs for two mating orientations. Each PCB carries an LED, a light guide or pipe, and a light insulator. Plug housing has an LED opening or exit, e.g., an actual hole or a number of small perforations. Light from LED may be guided by an LED housing towards light pipe which in turn may guide the light through the opening or exit. The light insulator can prevent stray light inside plug connector housing from being emitted through the exit.

SUMMARY OF THE INVENTION

An object of the present invention is to provide a cable connector assembly having an improved light structure.

To achieve the above-mentioned object, a cable connector assembly comprises a cable and a connector connected with the cable, the connector comprising: an insulative housing defining a receiving room; a printed circuit board (PCB) received in the insulative housing; a mating member mounted on the insulative housing and electrically connected with the PCB; a light member mounted on the PCB; a light guide member including a light emitting portion and a light transmission portion extending from the light emitting portion along a direction away from the PCB, the light emitting portion being columnar and having two opposite ends for emitting light from the light member to an outer side of the insulative housing; and an outer cover sealing an end of the insulative housing.

DETAILED DESCRIPTION OF THE PREFERRED EMBODIMENT

Reference will now be made in detail to a preferred embodiment of the present invention.

Figure 1:
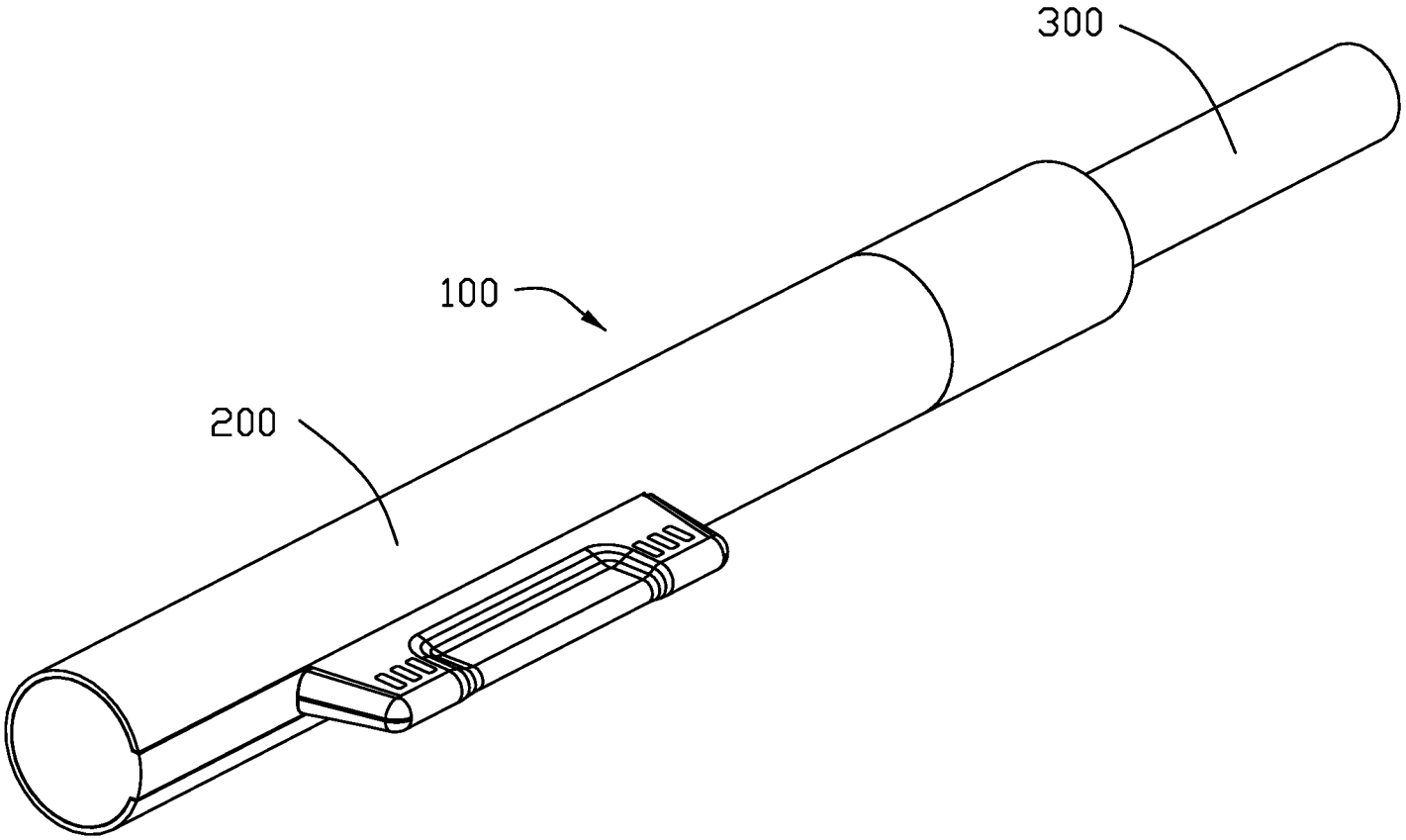
FIG. 1 is a perspective view of a cable connector assembly in accordance with present invention.
Figure 2:
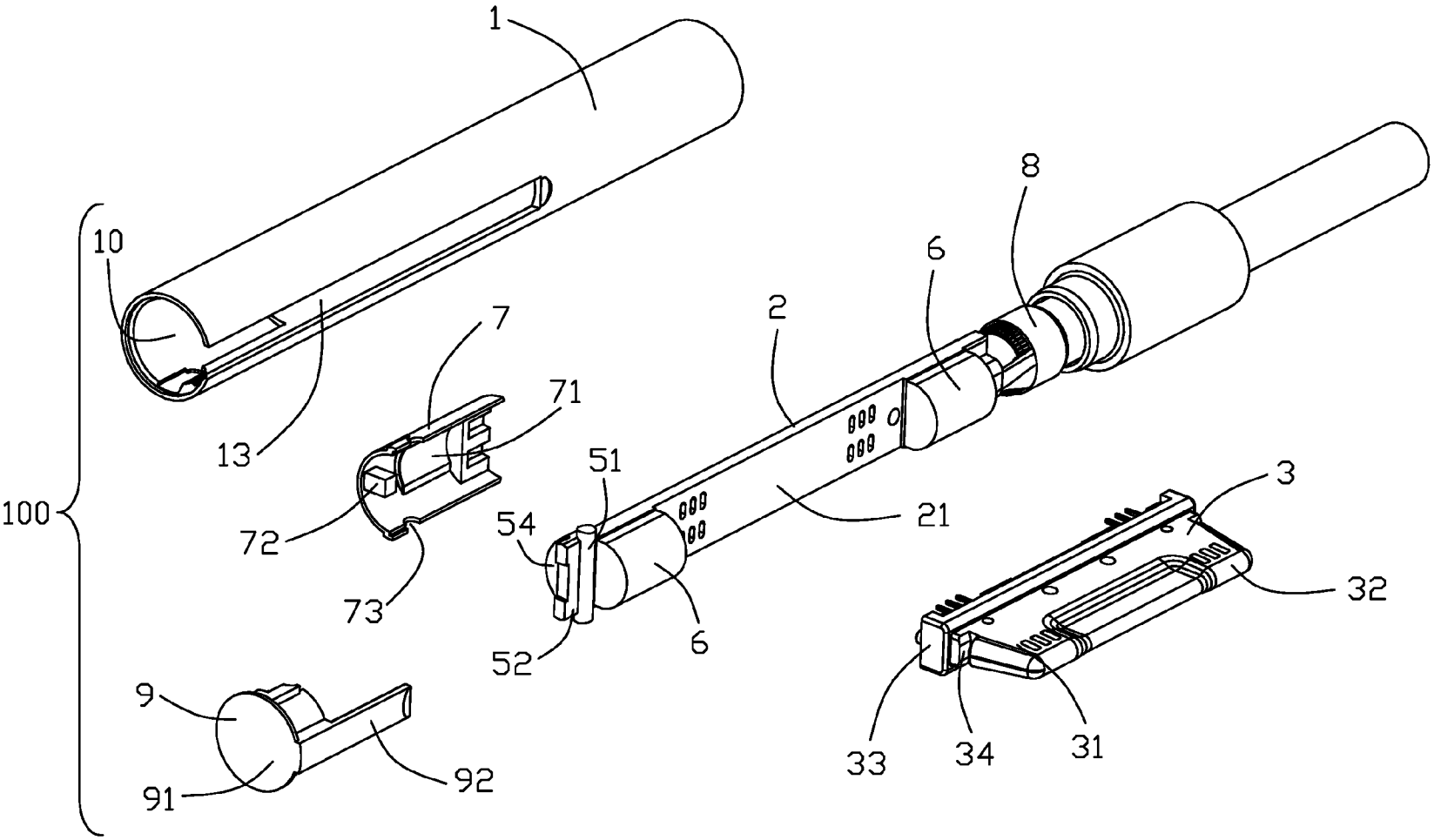
FIG. 2 is a partly exploded view of the cable connector assembly as shown in FIG. 1.
Figure 3:
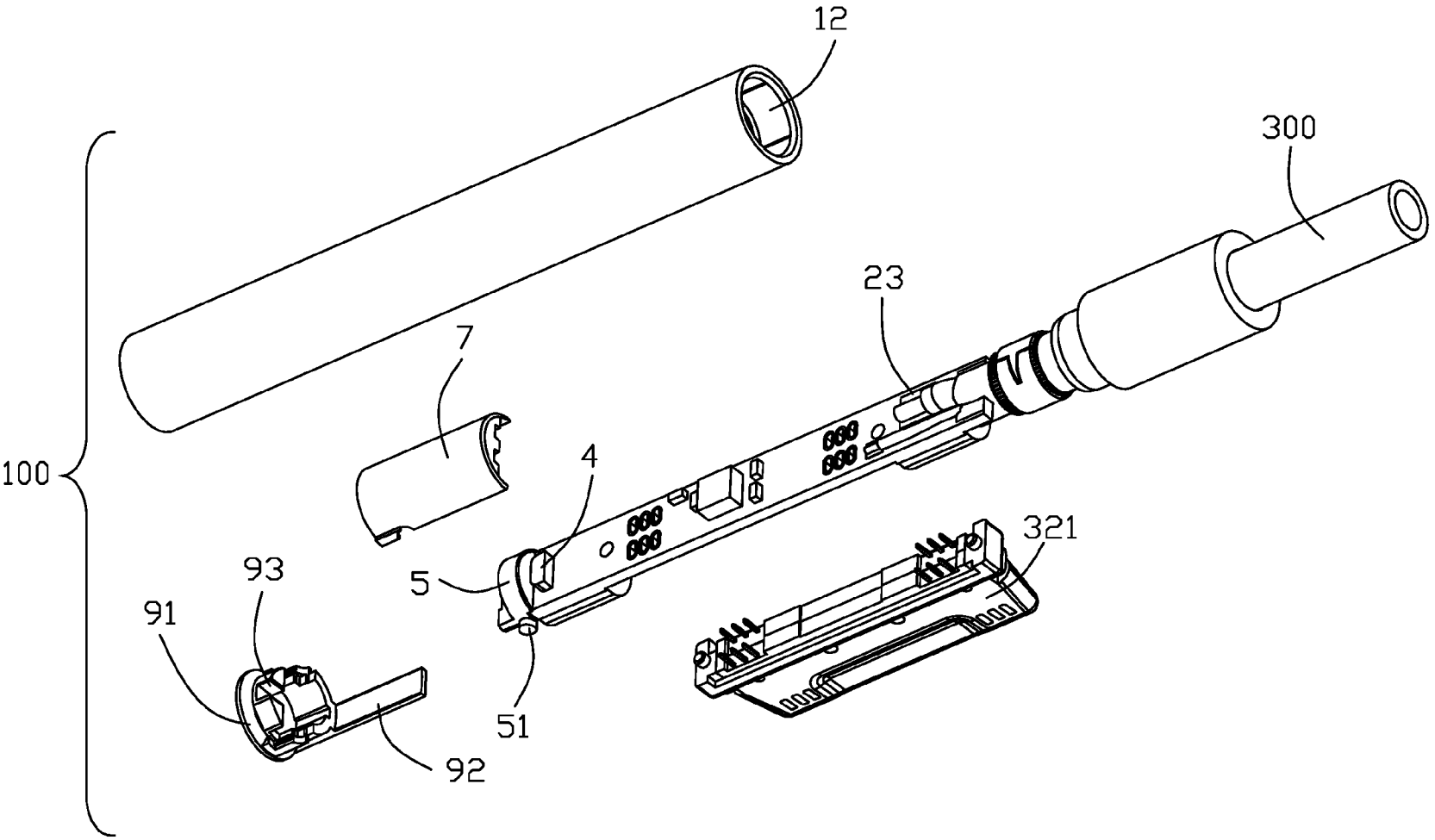
FIG. 3 is another partly exploded view of the cable connector assembly as shown in FIG. 2.
Figure 4:
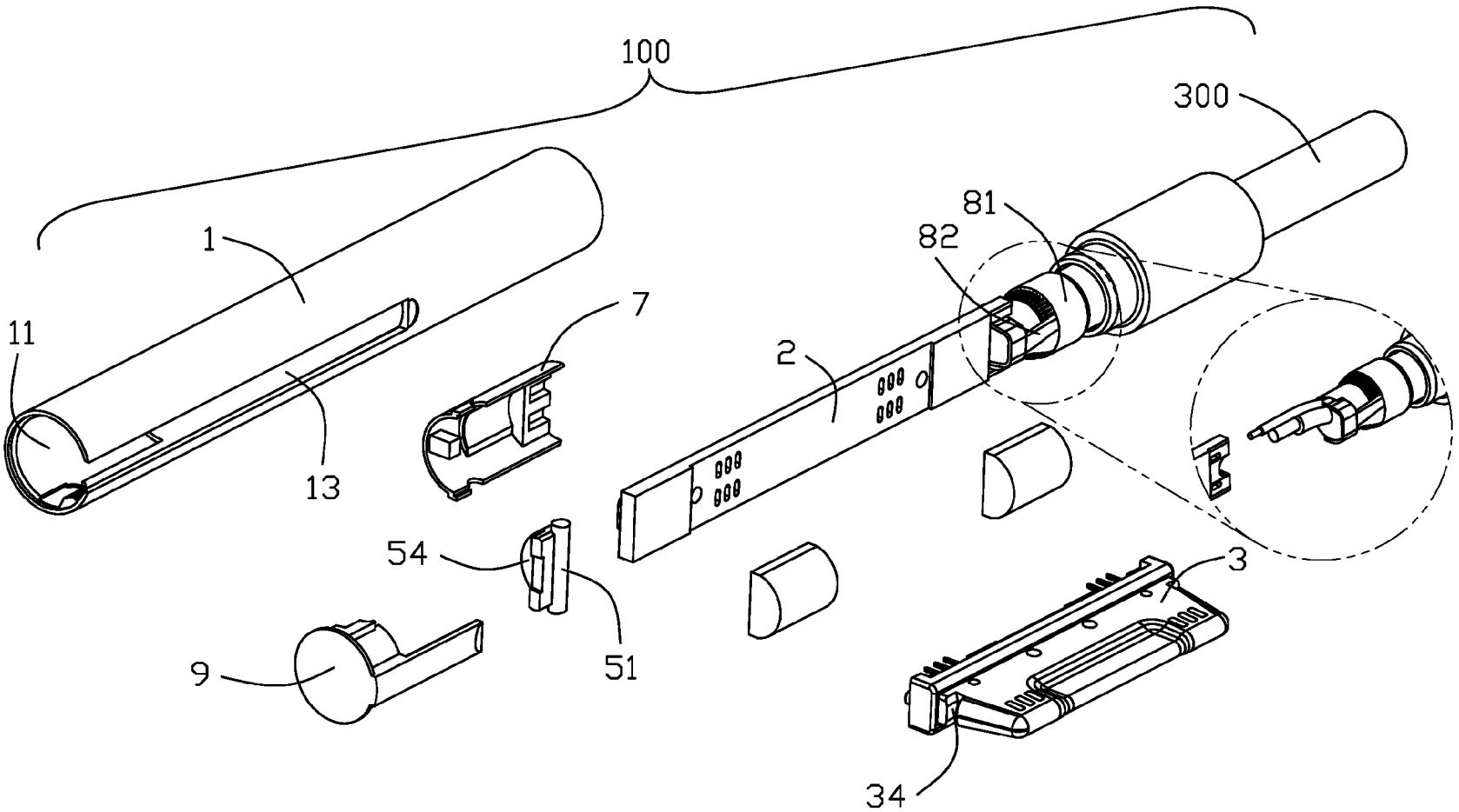
FIG. 4 is a further partly exploded view of the cable connector assembly as shown in FIG. 1.
Figure 5:
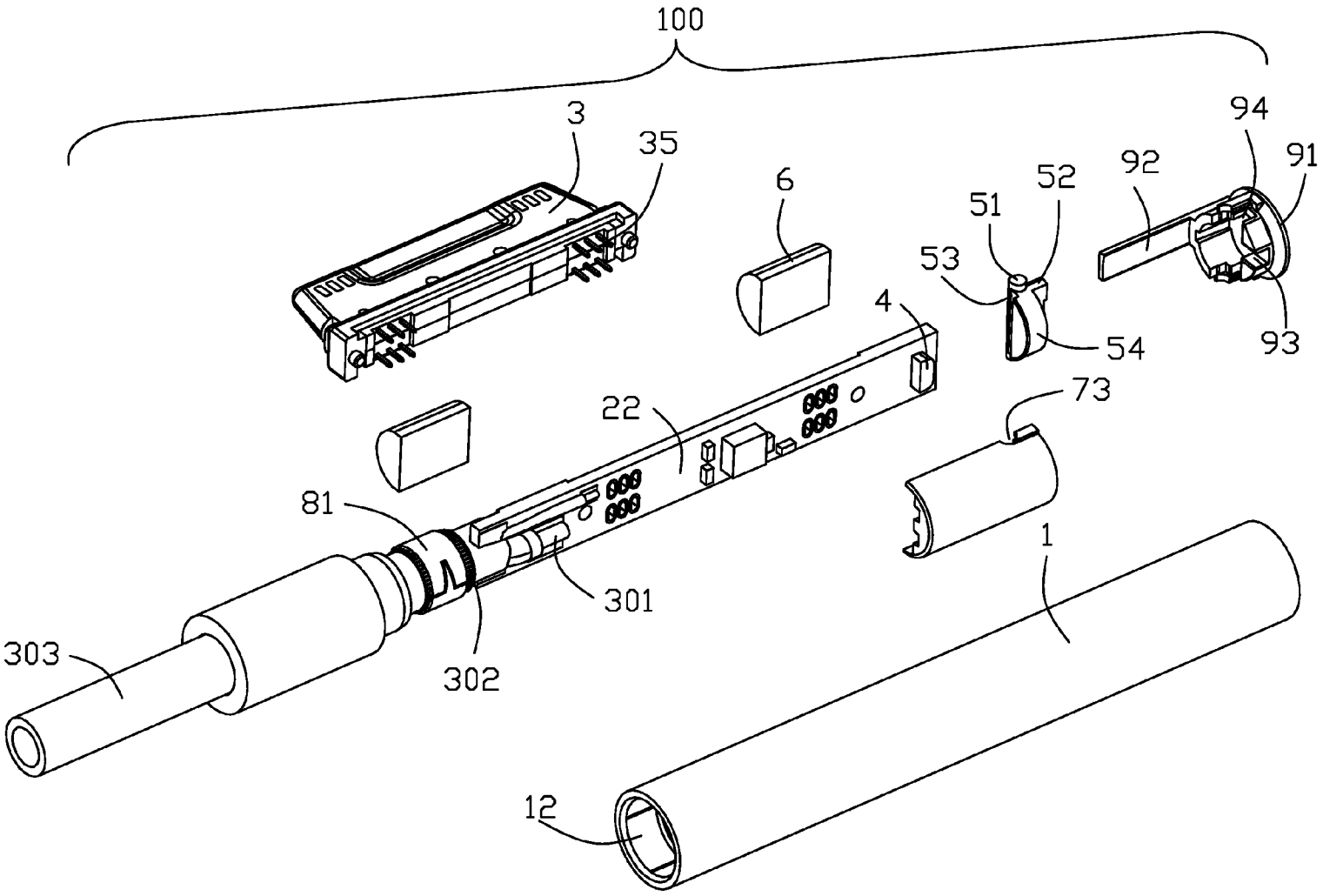
FIG. 5 is another further partly exploded view of the cable connector assembly as shown in FIG. 4.
Figure 6:
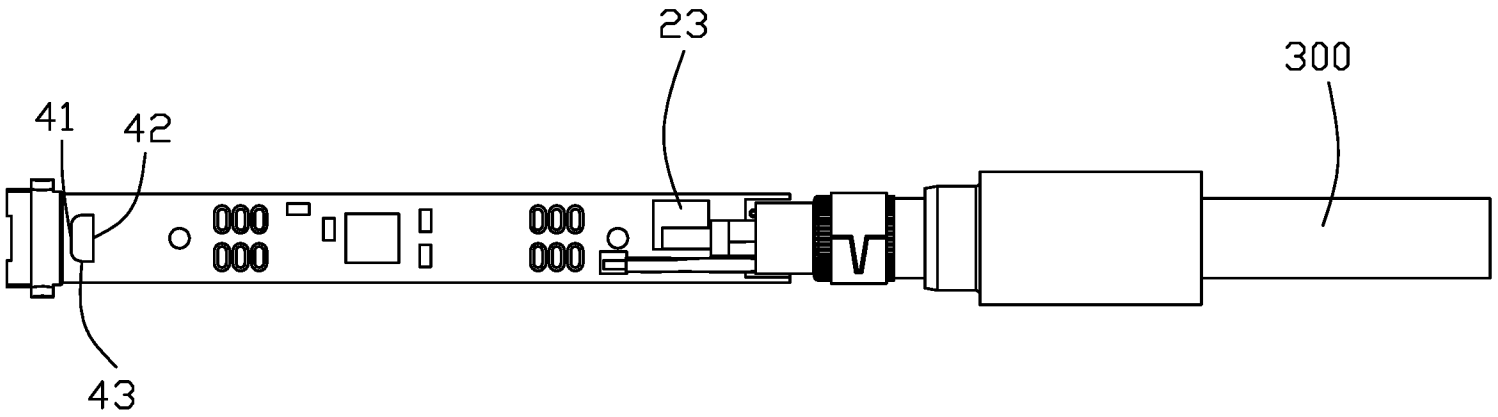
FIG. 6 is a rear view of the cable connector assembly (the insulative housing has been removed) as shown in FIG. 1.

Referring to FIGS. 1 to 6, a cable connector assembly 100 adapted for mating with a mating connector along two opposite mating directions, comprises a connector 200 and a cable 300 connector with the connector 200. The connector 200 comprises an insulative housing 1 defining a receiving room 10, a printed circuit board 2 received in the insulative housing 1, a mating member 3 mounted on the insulative housing 1 and electrically connected with the printed circuit board 2, a light member 4 mounted on the printed circuit board 2, a light guide member 5 for guiding the light emitting from the light member 4 to an outer side of the insulative housing 1, a pair of magnet members 6 mounted on the printed circuit board 2, an inner cover 7 covering the light member 4 and the light guide member 5, a crimp ring 8 crimped on the cable, and an outer cover 9 mounted on the insulative housing 1.

The insulative housing 1 has a cylinder shape. The insulative housing 1 comprises a first (side) opening 11, a second (side) opening 12 opposite to the first opening 11 and for the cable 300 entered into the insulative housing 1, and a front opening 13 perpendicular to and in communication with the first opening 11. The front opening 13 is in communication with the receiving room 10. The insulative housing 1 comprises light transmitting areas for the light transmitting through the insulative housing 1. The light transmitting areas are thinner than other portion of the insulative housing 1.

The printed circuit board 2 comprises first surface 21 and a second surface 22 opposite to the first surface 21. The mating member 3 is vertically mounted on the first surface 21, and the light member 4 is mounted on the second surface 22. The light guide member 5 is mounted on an end of the printed circuit board 2 adjacent to the first opening 11. The printed circuit board 2 comprises a plurality of conductive pads 23 for being soldered with the cable 300 and the crimp ring 8, respectively. Optimally, the corresponding side edge of the printed circuit board forms a notch to receive the front end portion of the cable 300, as shown in the circled enlarged portion of FIG. 4 wherein the cable is removed from the printed circuit board.

The mating member 3 is received in the receiving room 10 and has a portion extending beyond the insulative housing 1 to mate with the mating connector. The mating member comprises a body 31 comprising a mating portion 32 for mating with a complementary connector (not shown) and a mounting portion 33 received in the insulative housing 1. The mating portion 32 defines a pair of recesses 34 adjacent to the mounting portion 33 and in two opposite sides of the mating portion 32, respectively. The mating portion 32 comprises a first face 321 and a second face 322 opposite to the first face 321. The connector 200 comprises a plurality of conductive contacts 35. The number of the conductive contacts 35 disposed on the first face 321 is equal to the number of the conductive contacts 35 disposed on the second face 322. The mating portion 32 extends beyond the insulative housing 1 through the front opening 13 of the insulative housing 1 to mate with the mating connector.

The light member 4 is mounted on a second surface 22 of the printed circuit board 2. The light member 4 comprises a light emitting surface 41 adjacent to the light guide member 5, a bottom surface 42 opposite to the light emitting surface 41, and a pair of side surface 43 connected the light emitting surface 41 and the bottom surface 42, respectively. The light emitting surface 41 has a width smaller than a width of the bottom surface 42.

The light guide member 5 comprises a light emitting portion 51, a light transmission portion 54 extending from the light emitting portion 51 along a direction reversed with the mating direction, and a mounted portion 52 extending from the light emitting portion 51 along a direction perpendicular to a direction of the light transmission portion 54 extending. A stepped portion 53 is form by the light emitting portion 51 and the light transmission portion 54. The mounted portion 52 has a rectangular shape, and the light transmission portion 54 has a semicircle shape. An end of the printed circuit board 2 is received in the stepped portion 53 of the light guide member 5. The mounted portion 52 extends along the direction being aligned with a length direction of the printed circuit board 1. The transmission portion 54 extends along the direction perpendicular to the first surface 21 of the printed circuit board 2. The light emitting portion 51 has a column shape having two opposite ends with a diameter equal to 1 mm. The light is emitted to an outer side of the insulative housing 1 through the two ends of the light emitting portion 51. Notably, the housing 1 forms a thinner area corresponding to the end of the light emitting portion 51 for increasing transparency thereabouts for easy visibility for the user.

The magnet members 6 are mounted on a first surface 21 of the printed circuit board 1 and disposed at two opposite sides of the mating member 3, respectively. The magnet members are attracted with the mating connector to provide engagement force for the cable connector assembly 100 and the mating connector. The magnet members 6 are enclosed by insulative resin for being fixed on the printed circuit board 1 by glue or other adhesive insulating material.

The inner cover 7 is mounted on the second surface 22 of the printed circuit board 2. The inner cover 7 can prevent the light from the light member 4 wide divergence transmission. The inner cover 7 also can protect the light member 4 and light guide member 5. The inner cover 7 defines a receiving cavity 71 to receive the light guide member 5, and a recess 73 having a shape suit for receiving the light emitting portion 51. The inner cover 7 comprises a projected portion 72 disposed adjacent to the receiving cavity 71. Notably, in the invention, the inner cover 7 is essentially of a semi-cylindrical structure complying with the receiving room 10 so the light emitting portion 51 essentially extends along a diametrical path of one cross-sectional plane of the receiving room 10.

The cable 300 comprises a plurality of wires 301, a shielding layer 302 enclosing the wires 301, and jacket 303 enclosing the shielding layer 302. The cable 300 is mounted on an end of the printed circuit board 2 opposite to the end of the light member 4 and the light guide member 5 mounted on. The crimp ring 8 comprises a body portion 81 for being crimped on the jacket 302, and a soldering portion 82 extending from the body portion 81 for being soldered with the conductive pads 23.

The outer cover 9 is mounted on the insulative housing 1 to seal the first opening 11, and cooperated with the mating portion 32 of the mating member 3 to seal the front opening 13. The outer cover 9 comprises a main portion 91 for being mated with the first opening 11, and an extending portion 92 extending from the main portion 91 with a free end interference fitting with one of the recesses 34 of the mating portion 32. The extending portion 92 is cooperated with the mating portion 32 to seal the front opening 13. The outer cover 9 defines a receiving portion 93 for receiving the projected portion 72 when the outer cover 9 is covered with the insulative housing 1, and a latch slot 94 interference mating with the mounted portion 52 of the light guide member 5. Notably, the traditional light guide member essentially a single point light in one direction which essentially directs the light from an LED (light emitting diode) mounted upon the printed circuit board, or a ring type light. Differently, in the invention the light guide member 5 provides two opposite points light wherein the line linked between those two points is parallel to or coplanar with the printed circuit board rather than perpendicular thereto. In other words, such a linking line extends in a vertical direction perpendicular to both the front-to-back direction and the longitudinal/axial direction, and is perpendicular to the mating direction of the mating portion 32, thus making it convenient to view the indicating light for the user. On the other hand, the traditional light guide member is essentially required to be secured to the printed circuit board for assuring reliable transmitting light from the LED on the printed circuit board. Differently, in the invention, the light guide member 5 is essentially held by the outer cover 9 and/or the inner cover 7 so as to ease manufacturing of the whole assembly. Correspondingly, the light member 4 is located around a side edge region of the printed circuit board 2, and the light guide member 5 is essentially intimately located adjacent to the corresponding side edge of the printed circuit board 2.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising:

a cable; and a connector connected with the cable, the connector comprising: an insulative housing defining a receiving room; a printed circuit board (PCB) received in the insulative housing; a mating member mounted on the insulative housing and electrically connected with the PCB;

a light member mounted on the PCB;

a light guide member including a light emitting portion and a light transmission portion extending from the light emitting portion along a direction away from the PCB, the light emitting portion being columnar and having two opposite ends for emitting light from the light member to an outer side of the insulative housing; and an outer cover sealing an end of the insulative housing;

wherein the connector further comprises an inner cover covering the light member and the light guide member;

wherein the inner cover defines a receiving cavity to receive the light guide member;

wherein said inner cover forms a semi-cylindrical structure to protectively hold the light guide member.

2. The cable connector assembly as recited in claim 1, wherein the inner cover comprises a projected portion disposed adjacent to the receiving cavity, and the outer cover defines a receiving portion for receiving the projected portion.

3. The cable connector assembly as recited in claim 1, wherein the inner cover defines a recess receiving the light emitting portion.

4. The cable connector assembly as recited in claim 1, wherein the PCB comprises a first surface and a second surface opposite to the first surface, the mating member vertically mounted on the first surface, the light member mounted on the second surface.

5. The cable connector assembly as recited in claim 1 wherein the cable is mounted on an end of the PCB, and the light member and the light guide member are mounted on an opposite end of the PCB.

6. The cable connector assembly as recited in claim 1, further comprising a pair of magnet members received in the insulative housing and mounted on the PCB and at two opposite sides of the mating member, respectively.

7. The cable connector assembly as recited in claim 1, wherein the insulative housing comprises a light transmitting area for the light transmitted through the insulative housing, the light transmitting area being thinner than other portions of the insulative housing.

8. The cable connector assembly as recited in claim 1, wherein the light guide member comprises a mounted portion extending from the light emitting portion along a direction perpendicular to the light transmission portion, and the outer cover defines a latch slot interference fitting with the mounted portion.

9. A cable connector assembly comprising:

an insulative cylindrical housing defining a receiving room, opposite first and second side openings at two ends of the receiving room in a longitudinal direction, and a front opening forwardly communicating with an exterior and rearwardly communicating with the receiving room in a front-to-back direction perpendicular to said longitudinal direction, said front opening further communicating with the exterior in the longitudinal direction via said first side opening;

a printed circuit board received within the receiving room and adapted to be inserted into the receiving room via said first side opening in said longitudinal direction;

a mating portion mounted upon the printed circuit board and extending forwardly through the front opening in the front-to-back direction for mating with a complementary connector;

a cable connected to one side of the printed circuit board and extending through the second side opening outwardly;

a light member mounted upon the printed circuit board around the first side opening for generating light;

a light guide member located around a side edge of the printed circuit board around said first side opening to receive light derived from the light member; and an outer cover covering the first side opening and retaining the light guide member in position within the receiving room;

wherein said outer cover with secures the light guide member with directly or indirectly through an inner cover;

wherein said inner cover forms a semi-cylindrical structure to protectively hold the light guide member.

10. The cable connector assembly as claimed in claim 9, wherein said inner cover is retained to the outer cover and retains said light guide member.

11. The cable connector assembly as claimed in claim 9, wherein said light guide member includes a light emitting portion extending in a direction perpendicular to both said front-to-back direction and said longitudinal direction.

12. The cable connector assembly as claimed in claim 11, wherein said light emitting portion defines two opposite ends viewable from an outside.

13. A cable connector assembly comprising:

an insulative cylindrical housing defining a receiving room, opposite first and second side openings at two ends of the receiving room in a longitudinal direction, and a front opening forwardly communicating with an exterior and rearwardly communicating with the receiving room in a front-to-back direction perpendicular to said longitudinal direction, said front opening further communicating with the exterior in the longitudinal direction via said first side opening;

a printed circuit board received within the receiving room and adapted to be inserted into the receiving room via said first side opening in said longitudinal direction;

a mating portion mounted upon the printed circuit board and extending forwardly through the front opening in the front-to-back direction for mating with a complementary connector;

a cable connected to one side of the printed circuit board and extending through the second side opening outwardly;

a light member mounted upon the printed circuit board around the first side opening for generating light;

a light guide member located around a side edge of the printed circuit board around said first side opening to receive light derived from the light member;

said light guide member including a light emitting portion extending along a vertical direction perpendicular to both said front-to-back direction and said longitudinal direction with two opposite ends, along said vertical direction, easily viewable by the user during using;

an outer cover covering the first side opening; and an inner cover to cooperate with the outer cover for holding the light guide member in position within the receiving room;

wherein said inner cover forms a semi-cylindrical structure to protectively hold the light guide member.

14. The cable connector assembly as claimed in claim 13, wherein said two opposite ends are retained by the inner cover.

15. The cable connector assembly as claimed in claim 13, wherein said light emitting portion extends along a diametrical path of a cross-section of said receiving room.

* * * * *